United States Patent [19]

Lampietti et al.

[11] 4,082,935

[45] Apr. 4, 1978

[54] APPARATUS AND METHOD FOR MAKING WHEEL RIM BLANKS AND THE LIKE

[75] Inventors: Bernard P. Lampietti, Goshen; Erman V. Cavagnero, Torrington, both of Conn.

[73] Assignee: Torin Corporation, Torrington, Conn.

[21] Appl. No.: 706,831

[22] Filed: Jul. 19, 1976

[51] Int. Cl.[2] ..... B21H 1/10; B21K 1/38; B23K 31/06; B23K 13/02

[52] U.S. Cl. ..... 219/9.5; 29/159.1; 113/116 D; 219/10.11; 219/61; 219/101; 219/160

[58] Field of Search ..... 219/6.5, 7.5, 8.5, 9.5, 219/10.41, 10.43, 10.53, 10.57, 10.61, 10.67, 10.69, 10.73, 10.75, 59, 65, 67, 64, 101, 102, 105, 158, 160, 211; 29/159.1, 159.01; 113/1 M, 116 D, 116 W; 228/15.1, 17.5, 25, 44.1 R, 44.3, 47, 141, 144, 149, 150, 151, 164, 170, 173 R, 173 C, 173 D, 173 F, 212, 213

[56] References Cited

U.S. PATENT DOCUMENTS

| | | | |
|---|---|---|---|
| 1,696,455 | 12/1978 | Rupley | 219/160 |
| 1,808,261 | 6/1931 | Sessions | 219/64 |
| 1,924,915 | 8/1933 | Cutter | 219/65 |
| 1,944,096 | 1/1934 | Mayweg | 219/59 |
| 3,552,629 | 1/1971 | Armbruster et al. | 228/15.1 |
| 3,578,935 | 5/1971 | Deane | 219/64 |
| 3,584,178 | 6/1971 | Huber et al. | 219/59 |
| 3,610,863 | 10/1971 | Doublet | 219/59 |
| 3,794,805 | 2/1974 | Rudd | 219/7.5 |
| 3,934,324 | 1/1976 | Hess et al. | 228/17.5 |

*Primary Examiner*—Bruce A. Reynolds
*Attorney, Agent, or Firm*—McCormick, Paulding & Huber

[57] ABSTRACT

Wheel rim blank manufacturing apparatus comprises an elongated mandrel passing through Coiling, Welding and Machining Stations. Flat stock is fed transversely for coiling to cylindrical rim blanks about the mandrel. A transfer slide advances and maintains orientation of coiled rim blanks from the Coiling Station to the Welding Station. At the Welding Station clamps secure the blanks for resistance or high frequency current penetration welding. Internal clamps at the Welding Station have small shoulders for transferring the blanks past a Machining Station where a scarfing tool engages their welded areas. The method includes feeding stock transversely, coiling about a mandrel, advancing blanks along the mandrel, welding, again advancing the blanks, and machining weld areas.

40 Claims, 3 Drawing Figures

APPARATUS AND METHOD FOR MAKING WHEEL RIM BLANKS AND THE LIKE

BACKGROUND OF THE INVENTION

Wheel rim blanks for automotive and other uses have been manufactured in the past by first coiling and then welding sheet stock, the welds occurring along axial joint lines at contiguous end portions of the coiled blanks. Prior art manufacturing apparatus, however, has involved extensive material handling and transfer and even manual loading operations. Coiled rim blanks have been transferred, stored, re-oriented for introduction to welding apparatus, transferred, stored and once again re-oriented for introduction to various machining operations. Completely automated apparatus for the manufacture of wheel rim blanks in a continuous and high speed sequence of operations has not been heretofore available, one major difficulty being the necessary precise blank orientation for introduction to certain of the operations.

SUMMARY OF THE INVENTION

It is the general object of the present invention to provide a completely automated high speed apparatus and method for use in the manufacture of wheel rim blanks and the like.

In fulfillment of this object, an elongated mandrel is provided, rim blanks are coiled with their axes substantially co-incident with the axis of the mandrel, the blanks are then transferred along the mandrel to a Welding Station and precise blank orientation for welding is achieved at least in part during transfer. The blanks are then resistance butt welded or high frequency current penetration welded while clamped under forging pressure. A second part of the transfer means includes internal clamps which engage the blanks at the Welding Station and which optionally may also serve to orient blank end portions axially. After welding, the internal clamps move along slots in the mandrel to advance the blanks to and past a Machining Station for a broaching or scarfing operation at the weld area. An intermittently movable prop supports the mandrel adjacent its discharge end and accommodates rim blank passage therealong.

DESCRIPTION OF PREFERRED EMBODIMENTS

Figure 1:
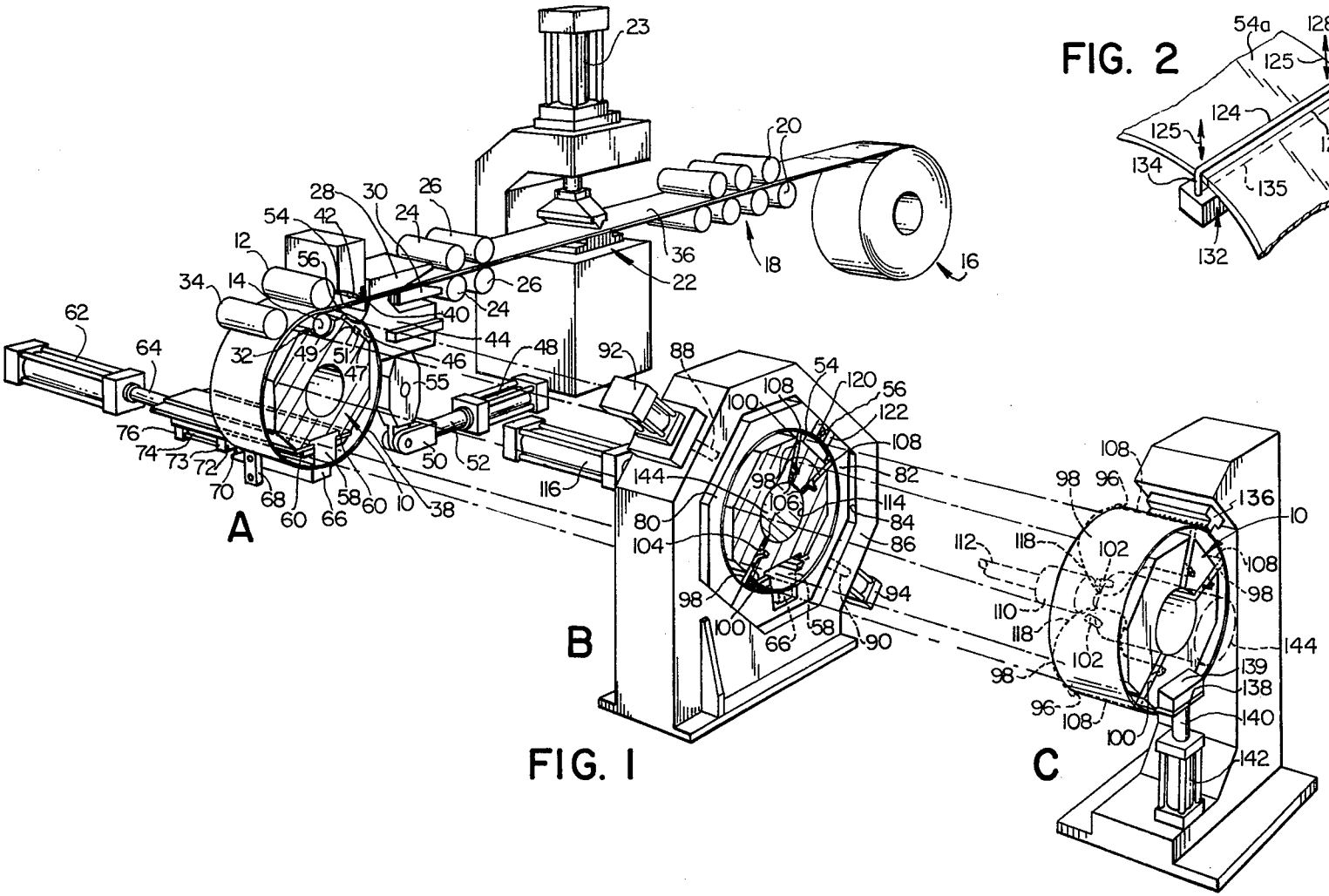
FIG. 1 of the drawings is a schematic illustration of the apparatus of the present invention and may also be referred to for illustration of the several steps of the method of the invention.

Referring particularly to FIG. 1, it will be observed that an elongated mandrel is provided as indicated generally at 10 and extends along a longitudinal and horizontal path through axially aligned Coiling, Welding and Machining Stations A, B, C. Additional work stations for secondary or auxiliary operations may of course be provided along the mandrel.

The cylindrical wheel rim blanks or the like are manufactured from flat or linear stock and, in accordance with the invention, lengths of such stock are fed successively along a path which extends transversely and generally radially with respect to the mandrel axis at the Coiling Station A. Stock feeding mechanism or means may comprise a pair of power operated oppositely disposed feed rolls as at 12, 14.

For a supply of linear stock, a pay-off mechanism may be provided as at 16 and may take conventional form maintaining the stock in coil form for rotation and successive discharge of integrally connected lengths of stock. Similarly, a conventional straightening or flattening mechanism or means may be provided as indicated generally at 18 at the discharge side of the pay-off mechanism. The straightening or flattening mechanism may include a plurality of straightening rolls 20, 20 disposed in conventional opposing relationship for passage of the stock therethrough.

A power operated press indicated generally at 22 and located adjacent and downstream of the straightener 18 may perform varying functions. That is, when integrally connected lengths of stock are fed to the Coiling Station A, the press 22 may be equipped with forming tools for performing contiguous end portions of adjacent lengths of stock. Alternatively, and when pre-cut individual lengths of stock are to be fed to the Coiling Station, the press may constitute a shearing mechanism or means. That is, the press tooling may be designed to sever individual lengths of stock and, optionally, the tooling may be adapted for both a severing and end preforming operation. The press may otherwise be conventional in all respects and may be fluid cylinder operated as indicated at 23 for intermittent forming, cutting or cutting and forming.

Additional stock feed means may also be provided and is particularly useful in the case where individual pre-cut lengths of stock are desired for introduction to the Coiling Station A. Such feed means may vary widely in form and may comprise a power driven and stock feeding pay-off mechanism, a power driven and stock feeding straightening means, an automatic feed mechanism as part of the press, and/or an additional or second set of feed rolls positioned downstream of the press, power driven and arranged oppositely to engage and to advance the stock. Two opposing pairs of such additional feed rolls are illustrated at 24, 26 adjacent the press discharge side.

Opposing or upper and lower guides 28, 30 may receive the linear stock in individual or integral lengths from the feed rolls 24, 26 and direct the same for precise entry to the aforementioned feed rolls 12, 14 at the Coiling Station A.

The feed rolls 12, 14 are preferably arranged with a lower or internal feed roll 14 disposed in a suitable recess 32 in the mandrel 10 so as to be within a rim blank coiled about the mandrel. An opposing upper or external roll is aligned substantially vertically above the roll 14 and the rim blank and the rolls may be conventionally power driven from the rear or left hand end portion of the mandrel.

At least one coiling tool is provided at the Coiling Station A and a coiling roll 34 is shown with its axis extending axially with respect to the mandrel and disposed at least partially in the linear path of movement of lengths of stock advanced by the feed rolls 12, 14. That is, the coiling roll 34 shown operates in a conventional manner in cooperation with the feed rolls 12, 14 to engage leading end portions of successively advanced lengths of stock and to obstruct the continuing linear advancement thereof whereby to cause the same to be coiled to generally cylindrical configuration about the mandrel 10.

In the illustrative example of FIG. 1, linear stock 36, withdrawn from the pay-off mechanism 16 and through the straightening mechanism 18 is preformed at contiguous end portions of adjacent stock lengths by the press 22 but is not severed into precut individual lengths of stock. Thus, the linear integral stock continues in its intermittent movement through the feed rolls 24, 26, the guides 28, 20, the feed rolls 12, 14 and a leading end portion of an integral length of stock is engaged by the coiling roll 34 at an initial portion of a coiling operation. Continued advancement of the length of stock results in the continued obstruction of linear stock movement by the coiling roll 34 and in the formation of a cylindrical rim blank 38 about the mandrel 10.

When the apparatus is adapted for making rim blanks from integral lengths of stock as described, the coiled blanks at the Coiling Station of course remain integral with the next succeeding length of linear stock. Accordingly, a cut-off means or mechanism is provided at the Coiling Station in this embodiment of the invention. The cut-off means may take the form of a shearing tool 40 which is movable under power operation intermittently toward and away from the trailing edges of rim blanks at the Coiling Station. Further, contiguous end portion finish forming tools may be provided in association with the cut-off mechanism. That is, the shearing tool 40 may also perform the function of finish forming a trailing end portion 54 of the rim blank 38, an arcuate forming surface 42 being provided thereon. As shown, the cut-off and forming tool 40 is disposed above the trailing end portion of the rim blank 38 adjacent the feed rolls 12, 14 and is movable generally vertically toward and away from the said end portion. Conventional operating means for the tool may be utilized, as for example, a fluid operable cylinder.

A second forming tool may also be provided as at 44 for engagement with and finish forming of a leading end portion 56 of a rim blank 38 coiled at the Station A. The tool 44 is shown adapted for movement generally horizontally beneath the next succeeding length of stock 36 and is provided with an arcuate forming surface 46 for engaging the rim blank end portion. Conventional means may be employed for operating the forming tool 44 in timed relationship with the cut-off and forming tool 40 and the feeding and coiling mechanisms. For example, a fluid operable cylinder such as 48 may be provided with a yoke 50 on its piston 52 and the yoke 50 may in turn be pivotally connected with a link 54 in turn pivotally mounted and operatively connected at an opposite end with the forming tool 44.

Mounted within a suitable mandrel recess and within the coiled rim blank 38 and arranged for cooperation with the cut-off and forming tools 40, 44 is an anvil 47. The anvil 47 may be slidably entered and secured in its operative position for ease in removal and replacement. Accordingly, a small dove-tailed guideway 49 is provided in the mandrel 10 adjacent the anvil 47 and a dove-tail anvil extension 51 is shown slidably entered therein.

On completion of coiling, cut-off and end portion forming operations at the Coiling Station A, the contiguous trailing and leading end portions 54, 56 of a rim blank such as 38 are disposed in preselected and fixed positions with respect to the mandrel 10. Similarly, when individual pre-cut lengths of stock are employed, preselected and fixed positions of the end portions can be established, as for example by precise control of the operation of the feed rolls 12, 14. Thus, a first step in rim blank orientation can be accomplished at the Coiling Station A.

In accordance with the present invention, orientation means is provided for the rim blank and, preferably, at least partial orientation control is exercised over the rim blanks during transfer from the Coiling Station A to the Welding Station B. Such control may be variously accomplished and at the least involves the exercise of a degree of control over the position of at least one of the contiguous end portions of the transferred rim blank. As illustrated, the apparatus of the present invention is adapted to exercise complete control over the position of both contiguous end portions 54, 56 and, in fact, over the rim blank as a whole throughout transfer between the Coiling and Welding Stations.

In accomplishing transfer of rim blanks from the Coiling to the Welding Station and in maintaining blank end portion position, the blanks are clamped and held bodily so as not to be inadvertently or accidentally dislodged from the position established at the Coiling Station A. Thus, the orientation or positioning means forms a part of a transfer means in the illustrative embodiment of FIG. 1. A longitudinally movable means or transfer slide 58 takes a T-shape in cross section in the embodiment shown and is disposed within a suitable axially extending recess at a lower portion of the mandrel 10. Opposing guide members 60, 60 may be provided beneath the arms of the "T" as illustrated. The slide 58 is movable in its recess or slot in the mandrel 10 between the Coiling Station A and the Welding Station B and may be operated, for example, by a suitable fluid operable cylinder 62 having a piston 64 connected therewith.

The orientation or positioning means includes a clamp means or clamp 66 disposed beneath the slide 58 in FIG. 1 and movable therewith as well as relative thereto. That is, the clamp 66 is operable to clamp a rim blank such as 38 at the Coiling Station A and thereafter to move with the transfer slide 58 to the Welding Station B. A pair of short depending arms 68, 68 mounted on the slide 58 pivotally support the clamp 66 adjacent a rear end portion thereof for generally vertical swinging movement of a forward end portion thereof toward and away from a lower portion of a rim blank such as 38. The vertical space between the slide 58 and the member 66 is, of course, dimensioned so that the up and down swinging movement of the clamp will serve respectively to clamp and to release a rim blank.

At a rear end portion of the clamp 66 an inclined camming surface 70 faces generally rearwardly and upwardly and cooperates with a forwardly facing frusto-conical surface 72 at a forward end portion of a ram 73 on a piston 74 associated with a small fluid operable cylinder 76 mounted on the slide 58. As will be apparent, the cylinder 76 may be operated to urge the ram 73 forwardly whereby to engage the inclined surface 70 and to pivot the clamp 66 such that its front end portion will swing upwardly and engage a rim blank and clamp the same against the lower surface of the slide 58. On withdrawal of the ram 73 from its forward position under the control of the cylinder 76, the clamp member 66 will swing downwardly at a forward end portion to release the rim blank for succeeding operations.

At the Welding Station B, at least two clamps are provided with at least one of the clamps movable intermittently toward and away from rim blanks such as 38 positioned at the station. As illustrated, two approximately 180° clamps 80, 82 are provided within a suitable recess 84 formed in a frame member 86 which extends about the mandrel 10. The clamps 80, 82 are each slidable in the frame member toward and away from a rim blank on the mandrel at the Welding Station and are preferably fluid cylinder operated. Cylinder pistons 88, 90 extend generally radially of the mandrel 10 and are connected respectively with the clamps 80, 82. The pistons 88, 90 are operated respectively by fluid cylinders 92, 94 mounted externally on the frame 86.

As will be apparent, the clamps 80, 82 can be urged generally radially inwardly by their respective cylinders and pistons to engage and to clamp a rim blank 38 disposed about the mandrel 10 and within the frame 86. The clamps are operable to urge the contiguous end portions 54, 56 of the rim blank 38 into engagement if space exists therebetween and to exert forging pressure for welding.

In accordance with the invention, the rim blank contiguous end portions 54, 56 are properly and precisely positioned for welding by orientation or positioning means of the invention and, when the arrangement of the transfer slide and clamp 58, 66 is employed, the clamp 66 may be maintained in engagement with the rim blank 38 at Welding Station B whereby to bodily secure and position the blank during at least an initial stage of operation of the clamps 80, 82. Subsequently, and during or after completion of welding, the clamp 66 may be released by operation of its cylinder 74 and the rim blank 38 will be freed for transfer to the machining operation at the Station C.

Figure 3:
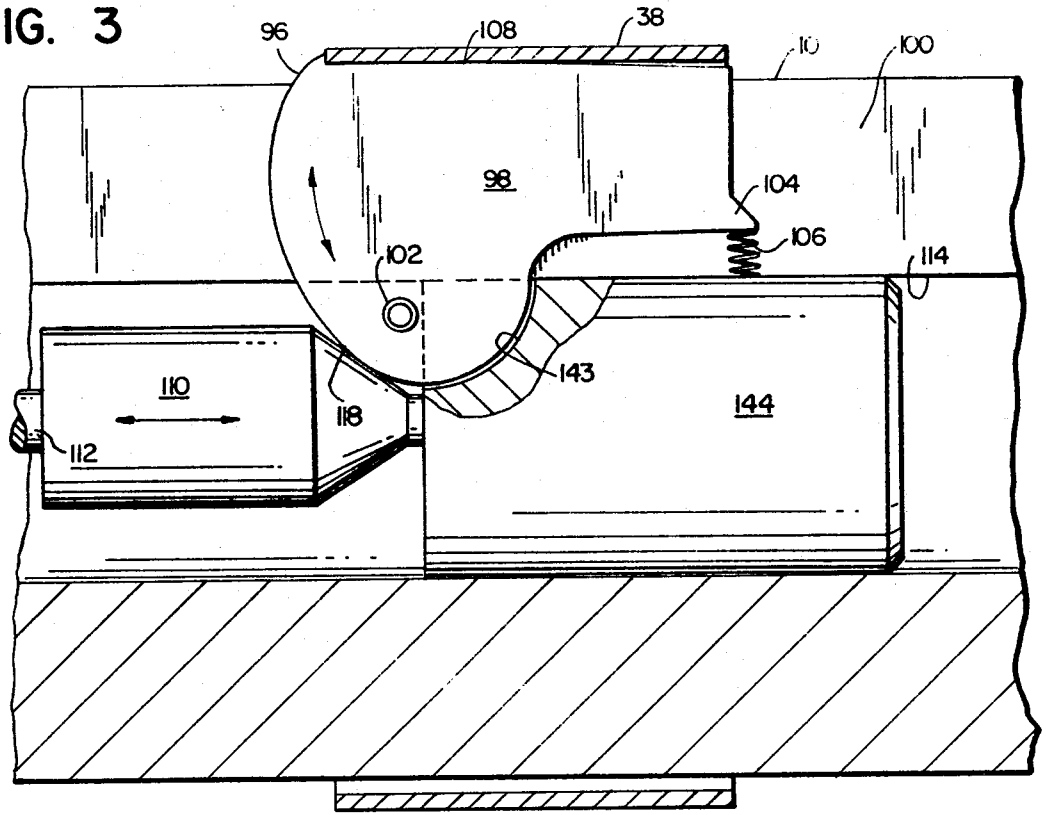
FIG. 3 is an enlarged fragmentary schematic illustration of a single clamping finger and its actuating means.

In accordance with the present invention, the orientation means thereof may include both radial and axial positioning means operable on the rim blanks. As explained, the transfer slide 58 and clamp 66 maintain rim blank position radially and at least partially axially during transfer between the Coiling and Welding Stations and at the Welding Station. A further axial positioning means optionally included at the Welding Station may take the form of at least one movable engageable with a side edge of a rim blank at the station and operable precisely to position axially the contiguous end portions of the blank. As shown, an axial positioning means takes the form of three upstanding shoulders or abutment surfaces 96, 96 one shown in FIG. 3, two shown in broken line form at the Machining Station C in FIG. 1, and which engage a rim blank 38 at the Welding Station at its rear or trailing edge. The shoulders 96, 96 are formed to extend generally radially outwardly at rear or trailing edge portions of three pivotally movable clamping members or fingers, 98, 98, one shown in FIG. 3. The fingers 98, 98 are disposed respectively in three radial and outwardly open slots 100, 100 formed in the mandrel 10 and extending axially therein from the Welding Station to and beyond the Machining Station C. At a radially inwardly extending portion thereof, each finger 98 is entered in a radial slot 143 in a guide cylinder 144 (shown in section at Station B and in broken line form at Station C). The guide cylinder 144 is slidable in a central mandrel opening 114 from the Welding Station B to and beyond the broken line position at Machining Station C. Cross pins 102, 102 fixed in the fingers 98, 98 are disposed with their ends free but adjacent rear open ends of the cylinder slots 143, 143 and are slightly spaced axially from the radial rear wall of the cylinder when the fingers are swung outwardly to engage their shoulders 96, 96 with a rim blank such as 38. Further, a lug 104 on each finger 98 is engaged by and serves as one seat for an associated biasing spring 106, oppositely seated on the cylinder 144 at an inner end of a mandrel slot 100. The biasing springs 106, 106 respectively urge leading or front end portions of the fingers 98, 98 in a generally radially outward direction, the fingers pivoting about their respective outer and front end portions engaging a leading portion of rim blank ID and about their respective cross pins 102, 102. The pins in this stage of operation move slightly forwardly to engage the rear wall of the cylinder 144. Flat generally axially extending clamping surfaces 108, 108 at trailing edge portions of the fingers 98, 98 are engageable and disengageable with the inner surfaces of rim blanks at the Welding Station B. Further, the biasing springs 106, 106 urge the fingers about their respective pins through arcs sufficient to permit the shoulders or abutment surfaces 96, 96 to be swung inwardly and to clear the ID's of the rim blanks.

Actuating means for the clamping and positioning fingers 98, 98 preferably comprise a frusto-conical ram 110 connected with the guide cylinder 144 and mounted at a forward end portion of a cylinder piston 112 within the central mandrel opening 114. A fluid operable cylinder 116 mounted within the mandrel opening operates the piston 112 and ram 110.

Inclined camming surfaces 118, 118 at the radial inner and rear portions of the fingers 98, 98 cooperate with the frusto-conical surface of the ram 110. That is, with the ram 110 retracted from the broken line position shown at the Machining Station C and disposed rearwardly of the Welding Station B and out of engagement with the camming surfaces 118, 118, the fingers 98, 98 reside in inoperative positions to accommodate the passage thereabout of a rim blank 38 during transfer of the blank from the Coiling Station A to the Welding Station B. With the rim blank positioned at the Welding Station, the cylinder 116 operates to urge its piston and ram 110 forwardly causing the frusto-conical surface of the ram 110 to engage the inclined camming surfaces 118, 118 on the fingers 96 and in turn pivoting the fingers to swing rear or trailing end portions thereof arcuately outwardly. It should be noted that the cross pins 102, 102 are at this stage swung slightly axially rearwardly and outwardly away from the rear cylinder surface. Rear or trailing portions of the finger clamping surfaces 108, 108 thus engage the rim blank internally to clamp the same and the shoulders or abutment surfaces 96, 96 are positioned in engagement with the rear or trailing edge of the blank. At this point, FIG. 1 Welding Station B, it should also be noted that two of the fingers 98, 98 are arranged circumaxially so as to engage the rim blank in relatively closely spaced relationship adjacent the weld area. That is, the two fingers 98, 98 engage the rim blank at or adjacent to the contiguous end portions 54, 56 thereof. Thus, the shoulders 96, 96 on said fingers are operable precisely to relatively position the contiguous end portions in an axial direction for welding.

The fingers 98, 98 thereafter may be maintained in operative position clamping the rim blank and reacting to the forces exerted by the clamps 80, 82 during welding or, alternatively, the clamping force of the fingers may be released by a slight back-off of the cylinder 116 during welding. On completion of welding, the clamping forces of the fingers are further maintained or reestablished. That is, the ram 110 is maintained or reestablished in an operative position and in engagement with the finger surfaces 118, 118. When it is desired to transfer a rim blank for machining it is necessary merely to effect a further or second portion of the stroke of the cylinder 116. On the occurrence of such further or second portion of the cylinder stroke, the shoulders or abutment surfaces 96, 96 on the fingers 98, 98 serve as pusher elements and the surfaces 108, 108 remain in firm engagement with the rim blank ID. Thus, the rim blanks may be transferred and securely held in position between the Welding Station B and the Machine Station C.

The manner in which welding is accomplished at the Station B may vary but resistance butt welding is presently preferred. Thus, first and second electrodes 120, 122 are shown and respectively engage the contiguous end portions 54, 56 of the rim blank 38 at the Welding Station. The electrodes 120, 122 are of course, connected with a suitable source of electrical power for effecting the weld at the joint between the said end portions, forging pressure being applied as aforesaid by the clamps 80, 82.

Figure 2:
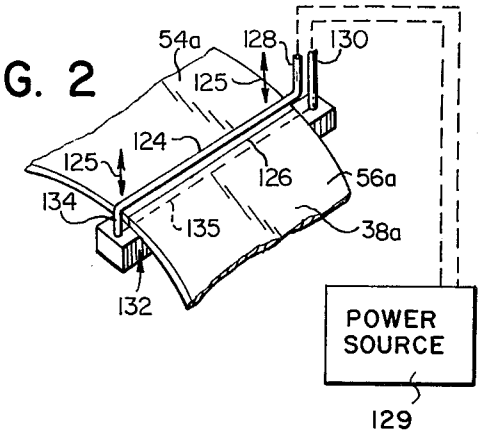
FIG. 2 is a fragmentary schematic illustration of high frequency current penetration welding apparatus which may be employed at the Welding Station.

In an alternative embodiment of the invention illustrated in FIG. 2, high intensity current penetration bar butt welding is employed. A proximity conductor or bar 124 is arranged along and adjacent a joint area 126 between contiguous end portions **54*a*, 56*a* of a rim blank 38*a*. The proximity conductor 124 is connected by a line 128 with a high frequency source of electrical power 129 which may be in the range of ten thousand (10,000) Hz and a second line from the source 130 extends to a conductor means 132 associated with the rim blank and the proximity conductor. The conductor means 132 includes a short electrically conductive member 134 connected with the proximity conductor 124. Further, the conductor means 132 preferably includes an elongated bar disposed internally and along and beyond the ends of the joint 126. The bar 132 engages and is thus electrically connected with both side edges of the rim blank 38*a* at the joint area 126. To allow for the axial introduction of rim blanks, provision is made for radial movement of either the proximity conductor 124 and conductor 134 and/or the bar 132. As shown, the proximity conductor 124 and conductor 134 may be regarded as the movable elements as indicated by arrows 125, 125**.

During welding, electrical current as indicated by broken line 135 flows through the proximity conductor 124, the conductor 134, and into the bar 132 at a projecting portion thereof spaced slightly from the front side edge of the rim blank **38*a*. The current then continues in a reverse direction in the bar 132 toward and to the side edge of the rim blank and along and through the joint area 126 in a closely confined path and provides intense heating. At the opposite side edge of the rim blank, the current returns to an oppositely projecting end portion of the bar 132 and thence to the line 130 and to the power source. Current flow through the proximity conductor 124** provides a low inductance path along and through the joint area and the high intensity heating of the weld area is thus achieved in an extremely short period of time. High intensity bar butt current penetration welding is a relatively new technique and for further information thereon, reference may be had to AMF Thermatool, Inc., New Rochelle, New York and to a paper presented at the AWS National Fall Meeting held in Baltimore, Maryland on October 5th–8th, 1970 by Wallace C. Rudd entitled, "Bar Butt Current Penetration Welding - A New High Frequency Process."

On completion of welding at the Station B with either of the apparatus and methods set forth above, and on transfer of the rim blank to the Machining Station C, the weld area is machined in one or more operations. Preferably, a fixed tool is provided at 136 and may take the form of a broaching or scarfing tool. The tool is aligned at least approximately longitudinally and axially with the weld area and the transfer means of the present invention and, more particularly, the fingers 98, 98 thereof are adapted to move rim blanks past the tool 136 for machining in passage. Alternatively, the transfer means including the fingers 98, 98 may be adapted to stop and to hold a rim blank at the Machining Station and movable tools may be employed to effect one or more machining operations.

On a still further stroke or portion of a stroke of the cylinder 116 the rim blanks are advanced along the mandrel 10 toward discharge. Manual or automatic means may, of course, be employed in discharge and further handling of the blanks and conventional means may be employed in further forming thereof to completed wheel rim configuration.

On discharge of a rim blank, and when a return stroke of the cylinder 116 commences, the ram 110 releases pressure on the inclined finger surfaces 118, 118 and the springs 106, 106 are operative as described to pivot the fingers 96, 96 slightly in a counterclockwise direction. The rim blank is thus released and the cross pins 102, 102 are brought into engagement with the guide cylinder rear wall. Further return movement of the cylinder rod 112, ram 110 and guide cylinder 144 thus results in withdrawal of the fingers to the Welding Station B for a subsequent clamping and transfer operation.

With substantial length and weight involved in the elongated mandrel configuration of the present invention, it is desirable if not necessary to provide a means of support for the mandrel adjacent its discharge end. Accordingly, a support means engageable with the mandrel and movable intermittently to accommodate the passage of rim blanks therealong, is provided in the form of a prop 138 movable upwardly and downwardly with and on a piston 140 operated by a vertically mounted fluid operable cylinder 142. Obviously, control may be exercised over the operation of the cylinder 142 to cause the prop 138 to move upwardly and to engage and support the mandrel 10 at a projecting lug 139, and to cause the prop to be withdrawn downwardly to accommodate the intermittent passage of rim blanks along the mandrel.

From the foregoing, it will be apparent that a substantially improved apparatus and method has been provided for the manufacture of wheel rim blanks. With the in-line and axially aligned arrangement of Coiling, Welding and Machining Stations and with the associated elongated mandrel passing through the Stations the necessary operations can be carried out rapidly and with a high degree of efficiency. Manual handling of the wheel rim blanks is minimized and, in fact, entirely eliminated from coil stock to completed wheel rim blank. The precise orientation of wheel rim blanks for proper introduction to the various operations is greatly facilitated with the arrangement shown and described. Still further, manpower employed is greatly reduced. Whereas several operators were necessary in the case of prior art wheel rim making apparatus, a single operator is sufficient with the present apparatus and, in fact, one operator may monitor more than one such apparatus.

We claim:

1. Apparatus for making generally cylindrical wheel rim blanks and the like from linear stock, said apparatus comprising coiling, welding, and machining stations arranged in spaced generally axially aligned relationship along a longitudinally extending horizontal path, an elongated mandrel with its axis arranged to extend horizontally and longitudinally along said path, stock feeding mechanism including a pair of power driven feed rolls arranged successively to advance lengths of stock to said coiling station in a linear path of movement which extends transversely and generally radially with respect to said mandrel, at least one coiling roll at said coiling station operable to engage and to coil successively advanced lengths of stock to generally cylindrical configuration about said mandrel, transfer means having longitudinally movable means engageable with coiled blanks at the coiling station and operable successively to advance the same along and about said mandrel to the welding station, at least two arcuate clamps at the welding station at least one of which is intermittently movable generally radially inwardly successively to engage blanks at the station, to urge contiguous ends of the blanks together and to exert forging pressure therebetween for welding, welding mechanism at said station operable to weld together the contiguous ends of successive blanks engaged by the clamps, said transfer means thereafter advancing the welded blanks in succession longitudinally along the mandrel to said machining station, at least one tool at said machining station for successively engaging and machining the blanks at their welded areas, said transfer means also advancing the machined blanks in succession longitudinally along the mandrel for discharge, and a power operated means intermittently engageable with the mandrel adjacent its discharge end and operable to support the same and to accommodate intermittent passage of the blanks therealong.

2. Apparatus for making generally cylindrical wheel rim blanks and the like as set forth in claim 1 wherein said linear rim blank stcok is fed from a coil in an elongated integral strip, said linear lengths of stock comprising successive integrally connected sections of the strip, and wherein a power driven cut-off device is provided at said coiling station and is operable successively to sever leading end lengths of the stock subsequent to coiling thereof.

3. Apparatus for making generally cylindrical wheel rim blanks and the like as set forth in claim 2 wherein a cut-off and forming anvil is provided adjacent said mandrel at said coiling station and within a rim blank coiled thereat, wherein said cut-off device cooperates with said anvil and also includes a forming tool engageable with at least one contiguous end portion of rim blanks at the coiling station and which cooperates with the anvil to form the said end portions.

4. Apparatus for making generally cylindrical wheel rim blanks and the like as set forth in claim 3 wherein a second power operated movable forming tool is provided at the coiling station for forming the other contiguous end portion of each rim blank in cooperation with said anvil.

5. Apparatus for making generally cylindrical wheel rim blanks and the like as set forth in claim 1 wherein a pay-off mechanism is provided for rotatably supporting elongated integral strip stock in coil form, integral linear lengths of stock being drawn successively therefrom, and wherein a straightening means is disposed between said pay-off mechanism and feed rolls, said straightening means being operatively associated with the strip of stock in opposing engagement therewith to straighten the same in passage therethrough.

6. Apparatus for making generally cylindrical wheel rim blanks and the like as set forth in claim 5 wherein a power operated forming mechanism is disposed between said straightening means and feed rolls and is operable intermittently to preform for welding but not to sever the contiguous end portions of successive integral stock lengths.

7. Apparatus for making generally cylindrical wheel rim blanks and the like as set forth in claim 5 wherein additional feed means is provided between said straightening means and said feed rolls.

8. Apparatus for making generally cylindrical wheel rim blanks and the like as set forth in claim 5 wherein said mandrel is provided with a feed roll recess at said coiling station, and wherein one of said feed rolls is disposed in said recess and within rim blanks formed at the station, the other and opposing feed roll being disposed externally of the blank.

9. Apparatus for making generally cylindrical wheel rim blanks and the like as set forth in claim 5 wherein a power operated shearing mechanism is provided between said pay-off mechanism and feed rolls and is operable intermittently to sever the stock whereby to provide said lengths of stock in pre-cut individual form.

10. Apparatus for making generally cylindrical wheel rim blanks and the like as set forth in claim 9 wherein said power operated shearing mechanism also includes forming tools for preforming end portions of said stock lengths for welding.

11. Apparatus for making generally cylindrical wheel rim blanks and the like as set forth in claim 9 wherein additional feed means is provided between said shearing mechanism and coiling station for advancing said pre-cut lengths of stock successively to said feed rolls at said coiling station.

12. Apparatus for making generally cylindrical wheel rim blanks and the like as set forth in claim 1 wherein said linear rim blank stock takes the form of pre-cut individual lengths of stock, and wherein additional feed means is provided successively to present said individual stock lengths to said feed rolls.

13. Apparatus for making generally cylindrical wheel rim blanks and the like as set forth in claim 1 and including orientation means for locating at least one of the contiguous ends of each rim blank for welding.

14. Apparatus for making generally cylindrical wheel rim blanks and the like as set forth in claim 13 wherein said orientation means engages rim blanks and is operable during transfer of the blanks from said coiling station to said welding station, the position of at least one rim blank end portion being thus maintained during transfer.

15. Apparatus for making generally cylindrical wheel rim blanks and the like as set forth in claim 14 wherein said orientation means is operable to locate both contiguous ends and the rim blank body and includes a clamp member operable with said transfer means between said coiling and welding stations, said clamp member being movable with and relative to said longitudinally movable means and operable to clamp a rim blank at the coiling station and during transfer whereby to maintain blank position during transfer to said welding station.

16. Apparatus for making generally cylindrical wheel rim blanks and the like as set forth in claim 13 wherein said orientation means includes both radial and axial positioning means operable on said rim blanks, said axial positioning means including at least one movable member engageable with a side edge of a rim blank at said welding station and operable precisely to relatively orient axially the contiguous ends of the blank for welding.

17. Apparatus for making generally cylindrical wheel rim blanks and the like as set forth in claim 16 wherein said radial positioning means engages rim blanks and is operable to maintain radial blank position during transfer of the blanks from said coiling station to said welding station.

18. Apparatus for making generally cylindrical wheel rim blanks and the like as set forth in claim 17 wherein said radial positioning means includes a clamp member operable with said transfer means between said coiling and welding stations, said clamp member being movable with and relative to said longitudinally movable means and operable to clamp a rim blank at the coiling station and maintain its position during transfer to said welding station, and wherein said axial positioning means includes at least three movable fingers each with a shoulder engageable with a trailing edge surface of a rim blank at the welding station, two of said fingers respectively engaging the edges of the contiguous end portions of the rim blank and precisely axially positioning the same relative to each other.

19. Apparatus for making generally cylindrical wheel rim blanks and the like as set forth in claim 1 wherein resistance butt welding is employed at said welding station, and wherein a pair of welding electrodes are provided externally of the rim blanks and adapted for power operated movement toward and away from the respective contiguous end portions of the rim blanks, said electrodes being maintained in inward positions and in firm engagement with their respective blank end portions during welding.

20. Apparatus for making generally cylindrical wheel rim blanks and the like as set forth in claim 1 wherein a plurality of power operated generally radially movable clamp members are provided internally of the rim blanks at the welding station.

21. Apparatus for making generally cylindrical wheel rim blanks and the like as set forth in claim 20 wherein said mandrel is provided with at least three radial outwardly open slots, wherein said clamp members comprise at least three pivotally supported fingers respectively entered in said slots and provided with biasing means urging the same out of engagement with an externally adjacent rim blank on the mandrel, and wherein a fluid operable cylinder is provided for actuating said fingers in unison and for pivotally urging the same into firm engagement with the rim.

22. Apparatus for making generally cylindrical wheel rim blanks and the like as set forth in claim 21 wherein said three fingers and fluid operable cylinder form a part of the aforesaid transfer means, at least one of said fingers having an upstanding shoulder at a rear end portion engageable successively with trailing edge surfaces of rim blanks at the welding station, and wherein said cylinder includes associated finger actuating means serving initially to pivot the fingers into engagement with rims at the station and serving thereafter on continuing cylinder operation to transfer the rims along the mandrel for machining, said shoulder on said one finger serving a rim pushing function.

23. Apparatus for making generally cylindrical wheel rim blanks and the like as set forth in claim 22 wherein each of said fingers has an upstanding shoulder for engaging and pushing rims, wherein each finger is provided with a rearwardly and inwardly inclined camming surface for effecting operative pivotal movement thereof, and wherein said finger actuating means includes a pusher cam engageable with said camming surfaces to pivot said fingers during a first portion of an operative cylinder stroke, said cylinder during a second portion of an operative stroke serving bodily to transfer the fingers along the mandrel whereby to transfer a rim from the welding station to the aforesaid machining station.

24. Apparatus for making generally cylindrical wheel rim blanks and the like as set forth in claim 23 wherein the aforementioned tool at said machining station is secured in a fixed position and in approximate longitudinal and axial alignment with the welds of the rims, and wherein said cylinder operative stroke is of sufficient length to cause the rims to be pushed past and to be machined by engagement with said tool.

25. Apparatus for making generally cylindrical wheel rim blanks and the like as set forth in claim 1 wherein the aforesaid tool at said machining station is secured in a fixed position and in approximate longitudinal and axial alignment with the welds of the rims on the mandrel, and wherein the aforesaid transfer means is operable to advance rims in succession from said welding station past and in cutting engagement with said tool.

26. Apparatus for making generally cylindrical wheel rim blanks and the like as set forth in claim 1 wherein high frequency, current penetration butt welding is employed at said welding station, wherein electrical welding means including a proximity conductor is provided with the conductor disposed longitudinally adjacent the contiguous ends of a rim blank at the welding station, and wherein high frequency electrical power source is provided and operatively connected with said welding means to cause current flow through said proximity conductor and in a reverse direction through and along the said contiguous ends of the rim blanks, said contiguous ends thus being heated for welding.

27. Apparatus for making generally cylindrical wheel rim blanks and the like as set forth in claim 26 wherein said welding means includes conductor means electrically connected with said proximity conductor and with said contiguous blank end portions adjacent at least one side edge of each rim blank, current flow occurring through said proximity conductor and conductor means and along and adjacent the skin of said contiguous end portions through a low inductance path formed therein by current in said proximity conductor.

28. Apparatus for making generally cylindrical wheel rim blanks and the like as set forth in claim 27 wherein said electrical conductor means is also electrically connected adjacent the other side edge of each rim blank at the contiguous end weld area and with said power source for current flow between said weld area and source.

29. Apparatus for making generally cylindrical wheel rim blanks and the like as set forth in claim 28 wherein said electrical conductor means includes a bar conductor engaging and extending along and at least to the ends of the weld area of each rim blank.

30. Apparatus for making generally cylindrical wheel rim blanks and the like as set forth in claim 1 wherein said power operated mandrel support means comprises a prop movable upwardly and downwardly beneath said mandrel in timed relationship with passage of rim blanks therealong.

31. Apparatus for making generally cylindrical wheel rim blanks and the like as set forth in claim 30 wherein a fluid operated cylinder is mounted beneath said mandrel, and wherein said prop is mounted on and moved upwardly and downwardly as aforesaid by said cylinder piston.

32. Apparatus for making generally cylindrical wheel rim blanks and the like from lengths of linear stock, said apparatus comprising coiling, welding and machining stations arranged in spaced generally axially aligned relationship along a longitudinally extending horizontal path, an elongated mandrel with its axis arranged to extend horizontally and longitudinally along said path, stock feeding mechanism arranged successively to advance lengths of stock in a linear and transversely extending path of movement to said coiling station, at least one coiling tool at said coiling station operable to engage successively advanced lengths of stock whereby to cause the same to be coiled to a generally cylindrical configuration, transfer means engageable with coiled blanks at the coiling station and operable successively to advance the same along and about said mandrel to the welding station, at least two arcuate clamps at the welding station at least one of which is intermittently movable inwardly successively to engage blanks at the station, welding mechanism at said station operable to weld together the contiguous ends of successive blanks engaged by the clamps, said transfer means thereafter advancing the welded blanks in succession longitudinally along the mandrel to said machining station, at least one tool at said machining station for successively engaging and machining the blanks at their welded areas, said transfer means also advancing the machined blanks in succession longitudnally along the mandrel for discharge.

33. Apparatus for making generally cylindrical wheel rim blanks and the like from lengths of linear stock, said apparatus comprisng coiling, welding and machining stations arranged in spaced generally aligned relationship along a longitudinally extending horizontal path, an elongated mandrel with its axis arranged to extend horizontally and longitudinally, stock feeding mechanism arranged successively to advance lengths of stock in a linear and transversely extending path of movement to said coiling station, at least one coiling tool at said coiling station operable to engage successively advanced lengths of stock whereby to cause the same to be coiled to a generally cylindrical configuration, transfer means engageable with coiled blanks at the coiling station and operable successively to advance the same along and about said mandrel to the welding station, orientation means for precisely positioning said blanks for welding at their contiguous end portions, at least two arcuate clamps at the welding station at least one of which is intermittently movable radially inwardly successively to engage blanks at the station, welding mechanism at said station operable to weld together the contiguous ends of successive blanks engaged by the clamps, said transfer means thereafter advancing the welded blanks in succession longitudinally along the mandrel to said machining station, at least one tool at said machining station for successively engaging and machining the blanks at their welded areas, said transfer means also advancing the machined blanks in succession longitudinally along the mandrel for discharge.

34. Apparatus for making generally cylindrical wheel rim blanks and the like from lengths of linear stock, said apparatus comprising coiling, welding and machining stations arranged in spaced generally axially aligned relationship along a longitudinally extending horizontal path, an elongated mandrel with its axis arranged to extend horizontally and longitudinally along said path, stock feeding mechanism arranged successively to advance lengths of stock in a linear and transversely extending path of movement to said coiling station, at least one coiling tool at said coiling station operable to engage successively advanced lengths of stock whereby to cause the same to be coiled to generally cylindrical configuration, transfer means engageable with coiled blanks at the coiling station and operable successively to advance the same along and about said mandrel to the welding station, at least two arcuate clamps at the welding station at least one of which is intermittently movable inwardly successively to engage blanks at the station, high frequency current penetration welding mechanism at said station comprising a proximity conductor and an associated conductor means and power source operable to weld together the contiguous ends of successive blanks engaged by the clamps, said transfer means thereafter advancing the welded blanks in succession longitudinally along the mandrel to said machining station, at least one tool at said machining station for successively engaging and machining the blanks at their welded areas, said transfer means also advancing the machined blanks in succession longitudinally along the mandrel for discharge.

35. Apparatus for making generally cylindrical wheel rim blanks and the like as set forth in claim 34 and including means for preforming end portions of each rim blank for welding.

36. Apparatus for making generally cylindrical wheel rim blanks and the like as set forth in claim 35 wherein said tool is fixed and wherein said transfer means advances each rim blank therepast for machining.

37. Apparatus for making generally cylindrical wheel rim blanks and the like as set forth in claim 34 and including means intermittently engageable with the mandrel adjacent its discharge end and operable to support the same and to accommodate intermittent passage of blanks therealong.

38. A method for making generally cylindrical wheel rim blanks and the like from linear stock, said method comprising the steps of providing coiling, welding and machining stations arranged in spaced generally axially aligned relationship along a longitudinally extending horizontal path, providing an elongated mandrel with its axis arranged to extend horizontally and longitudinally along said path, severing said stock and coiling rim blanks in a generally cylindrical configuration with their axis extending longitudinally, advancing the coiled blanks successively along and about said mandrel from the coiling station to the welding station while maintaining the position of at least one end thereof, welding the contiguous ends of the blanks together, advancing the welded blanks in succession longitudinally along the mandrel to and past said machining station, and machining the blanks at their weld areas in passage through the machining station.

39. A method for making wheel rim blanks as set forth in claim 38 and including the step of preforming the end portions to be welded.

40. A method for making wheel rim blanks as set forth in claim 39 wherein said welding step involves high frequency current penetration welding.

* * * * *

UNITED STATES PATENT OFFICE

CERTIFICATE OF CORRECTION

Patent No. 4,082,935 Dated April 4, 1978

Inventor(s) Erman V. Cavagnero & Bernard P. Lampietti

It is certified that error appears in the above-identified patent and that said Letters Patent are hereby corrected as shown below:

Column 2, Line 23
"performing" should be --preforming--.

Column 5, Line 42
after "movable" insert --member--.

Column 9, Line 40
"stcok" should be --stock--.

Column 13, Line 35
"longitudnally" should be --longitudinally--.

Column 13, Line 39
"comprisng" should be --comprising--.

Column 13, Line 40
after "generally" insert --axially--.

Column 13, Line 56
after "movable" delete --radially--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*